United States Patent [19]

Aidn

[11] Patent Number: 4,551,698

[45] Date of Patent: Nov. 5, 1985

[54] POLARIZED ELECTROMAGNETIC RELAY

[75] Inventor: Martin Aidn, Degerndorf, Fed. Rep. of Germany

[73] Assignee: Siemens Aktiengesellschaft, Berlin & Munich, Fed. Rep. of Germany

[21] Appl. No.: 558,466

[22] Filed: Dec. 6, 1983

[30] Foreign Application Priority Data

Feb. 3, 1983 [DE] Fed. Rep. of Germany ..... 3303665

[51] Int. Cl.[4] ..... H01H 51/22

[52] U.S. Cl. ..... 335/78; 335/80

[58] Field of Search ..... 335/78–85

[56] References Cited

FOREIGN PATENT DOCUMENTS 2423286 11/1975 Fed. Rep. of Germany ..... 335/80

1083873 9/1967 United Kingdom ..... 335/80

*Primary Examiner*—John C. Martin

*Assistant Examiner*—George Andrews

*Attorney, Agent, or Firm*—Hill, Van Santen, Steadman & Simpson

[57] ABSTRACT

A polarized electromagnetic relay including a coil body positioned over a core, and having at least one winding thereon. A permanent magnet is positioned in close proximity to the coil body. An armature externally embraces the coil winding and with the permanent magnet forms two working air gaps. Contact elements are provided embedded in a pedestal, the contact elements being disposed below the coil body. A monostable or a bistable switching behavior of the relay can be achieved by varying the design and disposition of the coil body, the windings, and one or more permanent magnets.

24 Claims, 27 Drawing Figures

POLARIZED ELECTROMAGNETIC RELAY

BACKGROUND OF THE INVENTION

1. Field of the Invention

This invention is in the field of polarized electromagnetic relays including a coil body which carries at least one winding and is provided with a centrally disposed core. A rocker armature is disposed outside the coil and is at least partially parallel to the coil axis. The rocker armature is pivotally seated at its center part and its two ends from working air gaps with ends of the coil core. The armature together with the coil core surround the coil winding and a permanent magnet is disposed next to the coil winding to actuate a movable contact system located below the coil body.

2. Description of the Prior Art

Polarized electromagnetic relays are known, for example, from DE-OS No. 30 46 947 and its British counterpart, British Pat. No. 2,066,577. In the arrangement shown, the permanent magnet is disposed parallel to the coil winding and is also provided with a shunt plate embedded in a block. A relay armature is pivotally mounted on the block for engagement and disengagement with the pole surfaces. With this arrangement, the permanent magnetic circuit is not well closed, reducing the sensitivity of the relay. Furthermore, the disposition of the permanent magnet requires a relatively large amount of space. In the known relay, the armature and contact carrier arrangement are disposed at the upper side of the magnet system and thereby produce relatively long paths for the contact leads.

SUMMARY OF THE INVENTION

The present invention provides a polarized relay having high sensitivity with an uncomplicated, space-saving structure containing as few parts as possible. The relay is suitable both for monostable and bistable operation.

In the relay of the present invention, the permanent magnet is disposed in offset relation in the axial direction relative to the coil winding. One pole of the magnet may lie directly on the coil core and the armature may be disposed between the coil winding and the permanent magnet on one side with a pedestal being disposed below the coil body and serving as a contact carrier for the movable contact elements. The result is a compact structure which is made possible by the disposition of the permanent magnet directly on the core. A high response sensitivity exists since the permanent magnet circuit is directly closed to the core over two branches across the armature and the two working air gaps. The permanent magnetic flux and the exciting flux are directly superimposed in the working air gaps. Short connecting paths for the contact elements exist since the contact arrangement is disposed in a pedestal below the magnet system, thereby also conserving space. Additional actuating slides can be eliminated due to the direct actuation of the contact elements by the armature.

The rocker armature is preferably seated in proximity to its center of gravity as by seating on a coil flange. For example, the armature may be seated on a cylindrically shaped rib of the coil flange by means of an impressed, cylindrical depression.

The actuation of the movable contact springs by the armature can be accomplished by providing an armature which has elbows at both ends and rests directly against the contact springs with the shoulders thereby formed. For the purpose of electrical insulation, the armature may be covered with an insulating film at those sections which face the movable contact elements. It is also possible to provide contact springs themselves with an insulating coating. In order to precisely define the distance between the armature and the contact arrangement, the coil body may be provided with projections in flange areas next to the armature, the projections resting against seating surfaces on the pedestal. The coil body can be connected to the pedestal by means of mortise or joggle joints. The contact terminal elements are conveniently embedded in the pedestal itself by means of extrusion coating, such that the contact surfaces of the cooperating contact elements as well as the seating surfaces for fastening movable contact springs terminate flush with the surface of the contact carrier. The movable contact springs can be secured to the seating surfaces of their terminal elements by means of welding or the like.

In a further embodiment, the movable contact elements can be seated on seating surfaces by means of an impressed bearing point and held there due to their spring bias relative to the armature. In a further modification, the movable contact elements can be secured to the armature itself over an insulator piece, and are electrically connected to their terminal elements at the pedestal by means of a conductive film.

The magnet system can be varied considerably by means of differing disposition of one or more windings as well as one or more permanent magnets. The simplest arrangement consists of a single winding and a single permanent magnet disposed next to it, whereby one lies approximately in the center of the axial length of the core and serves to seat the armature. Such a relay has a monostable characteristic since the armature at one side of the bearing will be directly attracted by the permanent magnet and will therefore always place itself on the permanent magnet side when the excitation is shut off.

Frequently it is not necessary to provide as much space for a permanent magnet as for the coil winding. In this case, two areas can be provided for the winding, the areas being interrupted by a flange which forms a bearing surface for the armature. On the other hand, it is also possible to provide a bearing point above the winding independently of a coil flange by providing a separate bearing piece that is secured to one or two coil flanges. With a symmetrical structure in the magnet system, the permanent magnet can also be provided in the center between two windings, whereby a bearing point for the armature is formed either directly by the permanent magnet or by a bearing piece located below the magnet.

In a preferred embodiment of the invention, the armature has offset portions terminating in end portions which are in close proximity to the core, the core being straight. In a modification, however, the armature can also be made straight and interact with a core which is elbowed at its ends. In a still further embodiment, both the armature as well as the core can be elbowed at their ends and thus identical parts can be employed for the armature and core with one being rotated 180° with respect to the other. The same advantage exists when the armature and the core are both provided with elbows at one end so that an elbowed end interacts with a straight end of the armature or of the core.

BRIEF DESCRIPTION OF THE DRAWINGS

Further details of the invention are explained in greater detail on the sample embodiments shown in the drawings, in which.

DESCRIPTION OF THE PREFERRED EMBODIMENTS

Figure 1:
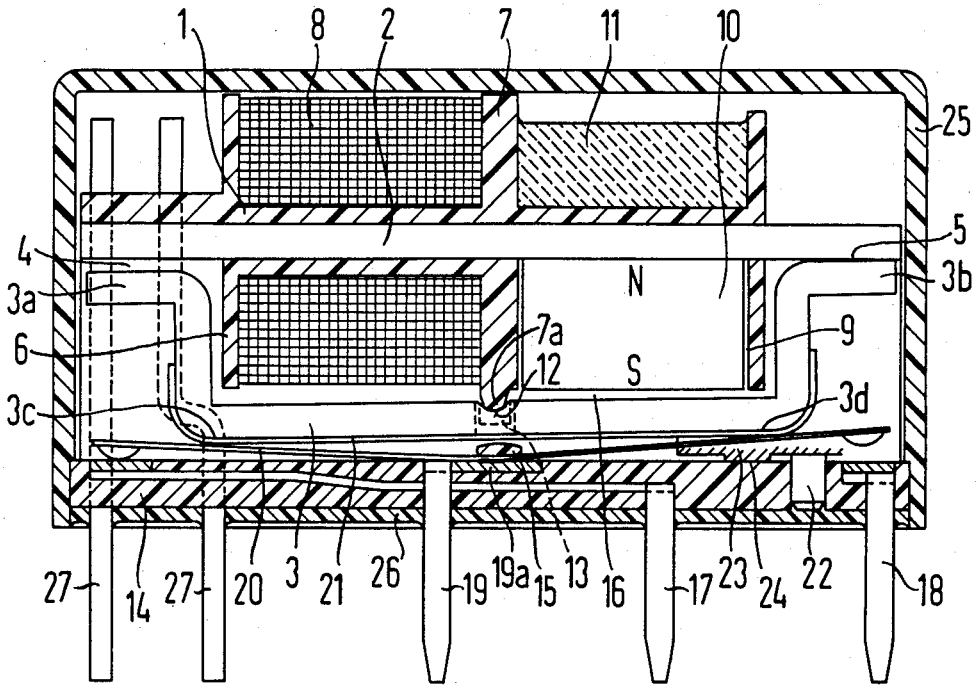
FIG. 1 is a cross-sectional view of an improved relay according to the present invention.

The relay illustrated in FIG. 1 includes a coil body 1 through which there extends a straight core 2. The core 2 forms two working air gaps 4 and 5 with an armature 3. The coil body 1 carries an exciting winding 8 between a pair of spaced flanges 6 and 7, thereby forming a space 9 for a permanent magnet 10 next to the flange 7. The permanent magnet 10 is directly seated on the core 2 with its one pole face. A getter 11 which, for example, can be introduced in a viscous state and then dried or can be used in the form of a tablet is provided in a further recess in the coil body which lies opposite to the permanent magnet.

The armature 3 is disposed beneath the coil body with its central portion approximately parallel to the core 2 and is pivotally seated about a horizontal axis proceeding at right angles relative to the longitudinal direction of the coil. A bearing 12 is provided in the form of a cylinder friction bearing whereby, in contrast to knife-edge bearings, only a slight specific surface pressure is provided but a higher frictional path occurs. Since the pivot angle of the armature is small, however, the friction path in the bearing is also small. A cylindrical depression 13 in the armature is provided with a high degree of smoothness and a cylindrical rib 7*a* having as smooth a surface as possible is formed on the coil flange 7. The combination of the metallic armature with the synthetic resin of the coil body produces a low wear bearing. Projections 13 of the bearing flange 7 project into lateral recesses of the armature 3 for lateral guidance of the armature, and as a mechanical impact protection. A rib 15 is formed on a pedestal 14 to limit the lifting of the armature 3 out of the bearing thus provided.

The armature 3 embraces both the coil winding 8 as well as the permanent magnet 10 with its generally U-shaped configuration. Its free ends 3*a* and 3*b* extend substantially parallel to the core 2 for the formation of the working air gaps 4 and 5. The flux of the permanent magnet 10 divides in the core 2 to the two working air gaps and proceeds from there over the armature 3 and an air gap 16 back to the permanent magnet. The relay is sensitive to the direction of current due to the superimposition of the permanent magnet flux with a control flux in the working air gaps 4 and 5. The asymmetrical disposition of the permanent magnet 10 lends the magnet system a monostable characteristic. This occurs because the length of the magnetic circuit from the permanent magnet 10 to the working air gap 5 is shorter than to the working air gap 4 and, moreover, the air gap 16 between the permanent magnet 10 and the armature 3 is smaller with a closed working air gap 5 than it is with a closed working air gap 4. As a result, the working air gap 5 is preferred by the permanent magnet flux so that the greatest tractive power always arises there. The monostability of the magnet system can be enhanced or diminished by means of additional influencing factors, for example, pole surfaces of different sizes, partition plates, compensating springs, and the like.

The electrical contact system is disposed directly below the armature 3, with the pedestal 14 serving as the carrier. Cooperating contact elements 17 and 18 in pairs as well as terminal elements 19 are provided for movable contact springs 20 and injected into the pedestal 14. The movable contact springs 20 are welded to a seating surface 19*a* and are upwardly biased toward the armature 3 so that they are directly actuated by shoulders 3*c* or 3*d* of the armature. For purposes of electrical insulation the armature is coated with an insulating film 21 in this area.

Figure 5:
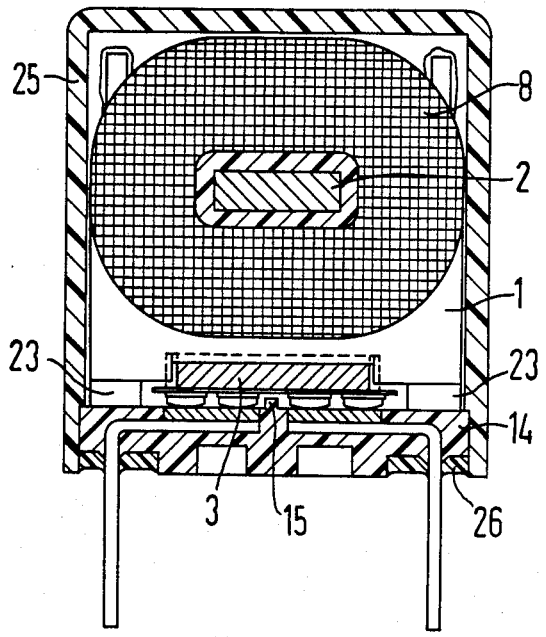
FIG. 5 is a cross-sectional view of the completed relay shown in FIG. 1.

The magnet system with the coil body 1 acting as a carrier and the contact arrangement on the pedestal 14 as the carrier are connected together by a pin and socket joint such as a mortise or joggle joint 22. Projections 23 of the coil body 1 are positioned to lie against seating surfaces 24 of the pedestal and thereby produce the proper spacing between the armature 3 and the contacts. A protective cap 25 in combination with the edge of the pedestal 14 provides a groove as shown in FIG. 5. The housing gap between the pedestal 14 and the protective cap 25 is sealed by means of casting a synthetic resin in the groove 26. At the same time, the contact terminals 17, 18 and 19 as well as the coil terminals 27 are additionally sealed.

Figure 2:
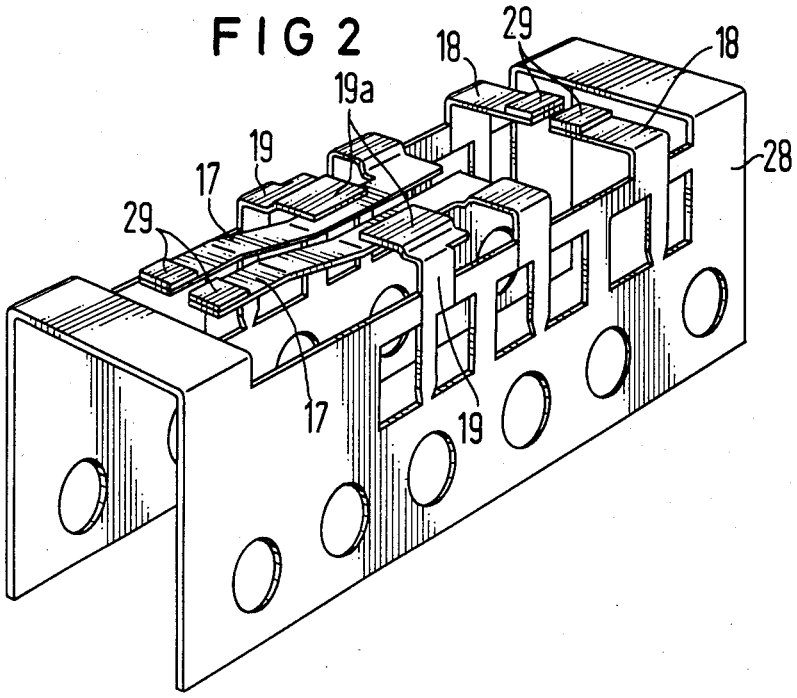
FIG. 2 is a view in perspective of a contact terminal arrangement for the relay of FIG. 1 before extrusion coating.
Figure 3:
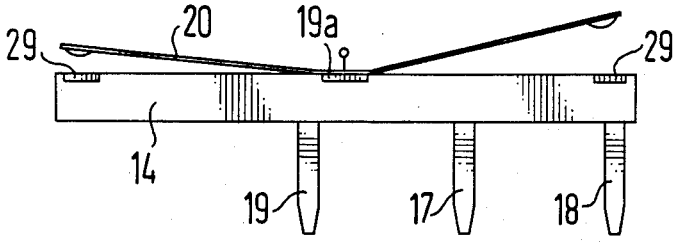
FIG. 3 illustrates a pedestal with contact elements in a side view.

FIGS. 2 and 3 show the contact arrangement before and after the extrusion coating in the pedestal 14. The cooperating contact elements 17 and 18 as well as the terminal elements 19 for the contact springs 20 are provided by a plate blank 28 which is cut out and bent into a U-shape as shown in FIG. 2. Contact pieces 29 have previously been welded to the corresponding contact elements 17 and 18. The plate blank is then extrusion coated with a synthetic resin. The connections to the connecting strips from the contact pieces to the terminal lugs thereby are insulated at the inside of the pedestal. By pressing the planar contact pieces 29 and the contact spring welding surfaces 19*a* against a planar injection mold, these surfaces are not coated with the synthetic resin and lie in a single plane after the extrusion coating. To prevent synthetic resin vapors from depositing on the contact surfaces during extrusion coating, these surfaces can be provided with a protective coating that is rinsed off after the extrusion coating has been completed.

The terminal lugs are cut free at the finished pedestal 14 and the contact springs 20 are welded to the surfaces 19*a*. Contact springs 20 are pre-bent in order to obtain a desired bias relative to the armature 3. The armature 3 is held in its bearing after assembly of the relay due to the bias of the contact springs and due to the permanent magnet attractive forces so that a separate bearing spring is not necessary.

Figure 4:
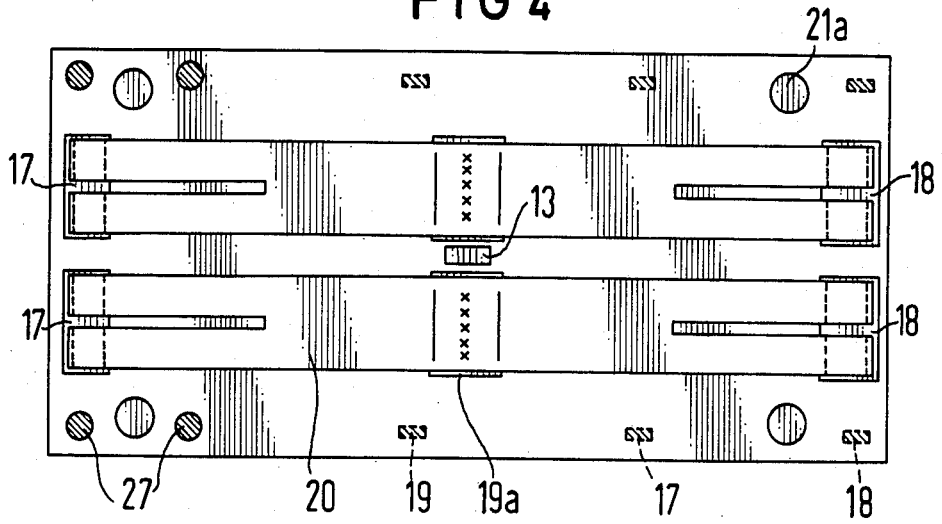
FIG. 4 is a plan view of the structure shown in FIG. 3.

FIG. 4 shows the finished pedestal 14 as viewed from above. The two contact springs 20 are welded on and their contacting ends lie over the cooperating contact elements 17 and 18. The pedestal 14 is provided with holes 21*a* for accepting fastening pegs on the coil body 1. The coil terminal pins 27 are also co-embedded. FIG. 5 shows a cross-sectional view through the completed relay.

Figure 6:
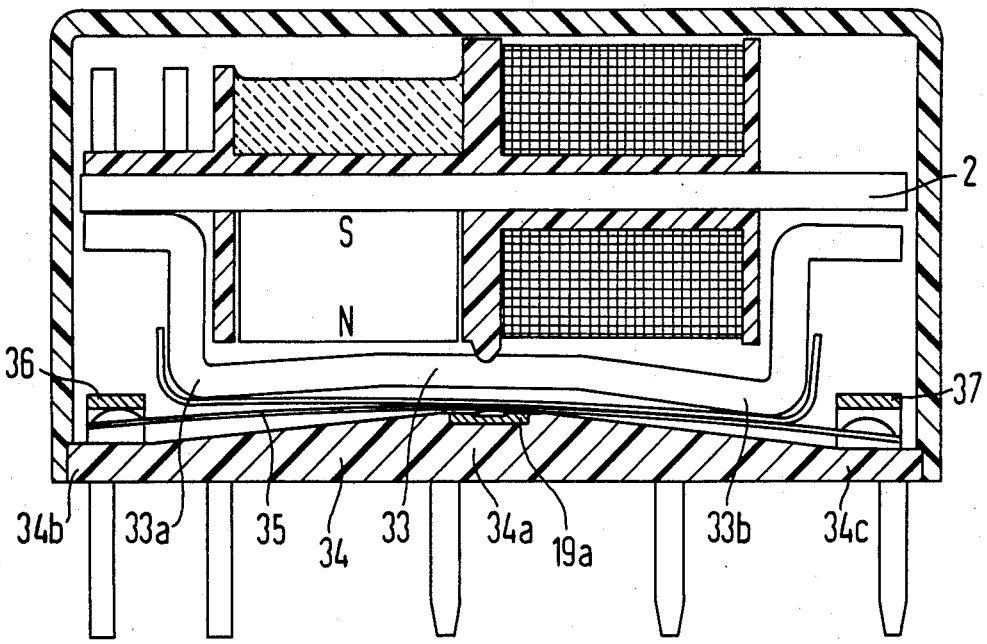
FIGS. 6 through 9 illustrate modified forms of the relay.

With the relay according to FIGS. 1 through 5, the contact unit is equipped with external pressure contacts, i.e., the contact pressure is generated by the pressure of the armature 3 against the contact springs 20. FIG. 6 shows a modification of the relay wherein inherent pressure contacts are employed. The contact pressure arises due to prestress of movable contact springs 35 relative to cooperating stationary contact elements 36 and 37 which are fastened to the pedestal 34 and extend over the contact springs 35. In the example of FIG. 6, the bias of the planar contact springs 35 relative to the cooperating contact elements 36 and 37 is achieved in that the pedestal 34 is higher in its central area 34*a* in which the contact spring 35 presses than it is in the lateral areas 34*b* and 34*c* where the cooperating contact elements 36 and 37 are disposed. In its relaxed condition, the contact spring 35 presses against the cooperating contact elements 36 or 37 even without a prestress bending. In order to be able to actuate the contact spring in this case, the armature 33 is bent down at its shoulder portions 33*a* and 33*b*. In other particulars, the relay shown in FIG. 6 is fundamentally constructed exactly like the relay shown in FIG. 1.

Figure 7:
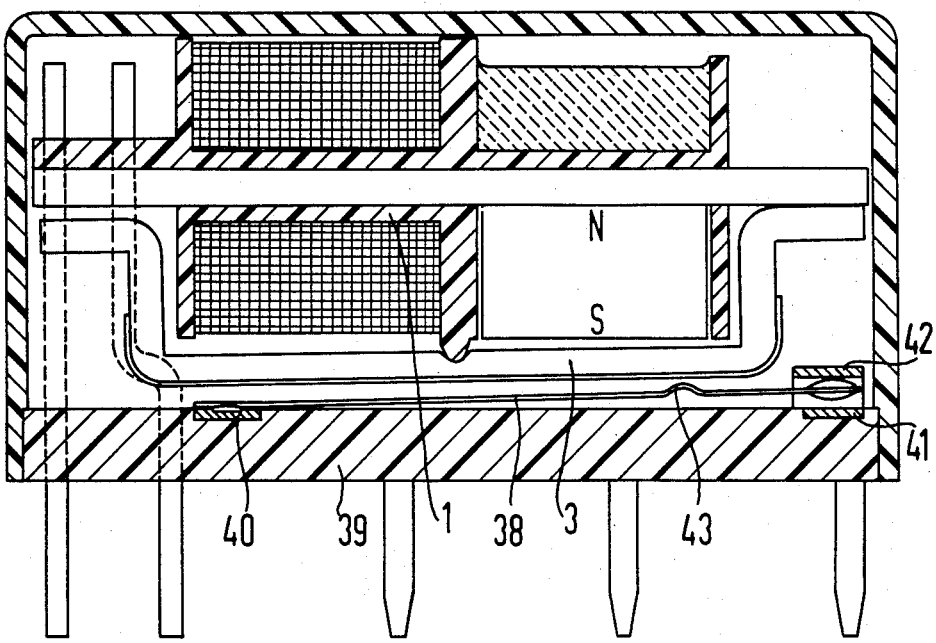

FIG. 7 shows a further modification of the relay whereby, in contrast with the embodiment of FIG. 1, a changeover contact is achieved not from cooperating contact elements disposed at opposite ends of the relay but with two cooperating contact elements lying one above the other. A movable contact spring 38 is secured to a terminal element 40 at one side of a pedestal 39 and its free end can be switched between two cooperating contact elements 41 and 42. A bead 43 is impressed in the contact spring to serve as a contact point for the armature. A particularly long, free spring length is obtained for the contact spring 38 in this embodiment.

Figure 8:
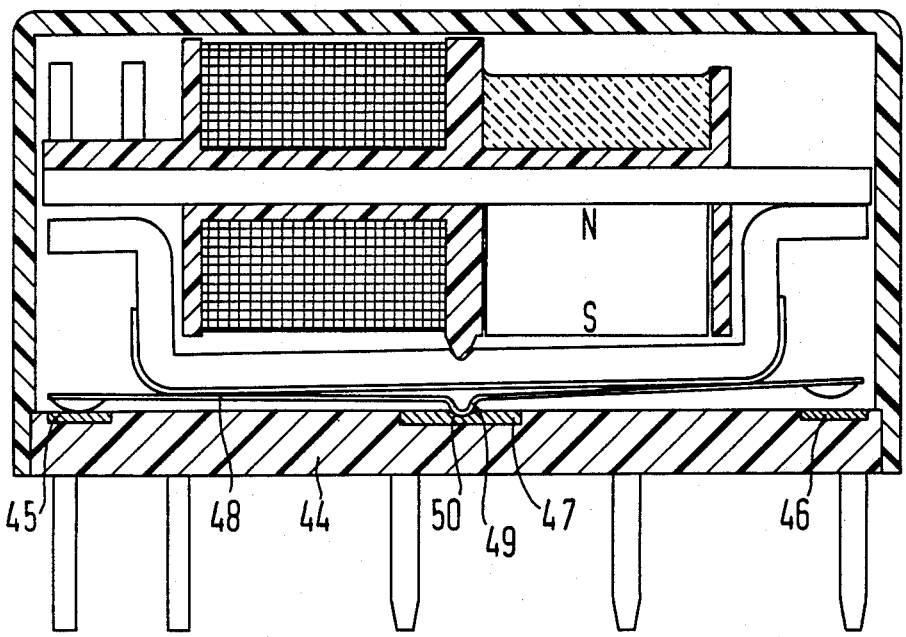

The embodiment of FIG. 8 shows an external pressure contact arrangement with loosely inserted contact springs. A pedestal 44 having cooperating contact elements 45 and 46 as well as a terminal element 47 for a contact spring 48 is designed similar to the pedestal 14 shown in FIG. 1. However, the contact spring 48 is not secured to the terminal element 47 by means of welding but is seated by means of a bead 49 in a shallow recess 50 of the terminal element 47. The spring is positively held in the roller bearing formed by the recess 50. The parts in the bearing area can be coated with a precious metal in order to reduce the current conduction resistance. A corresponding modification with loosely inserted contact springs is also possible with inherent pressure contacts.

Figure 9:
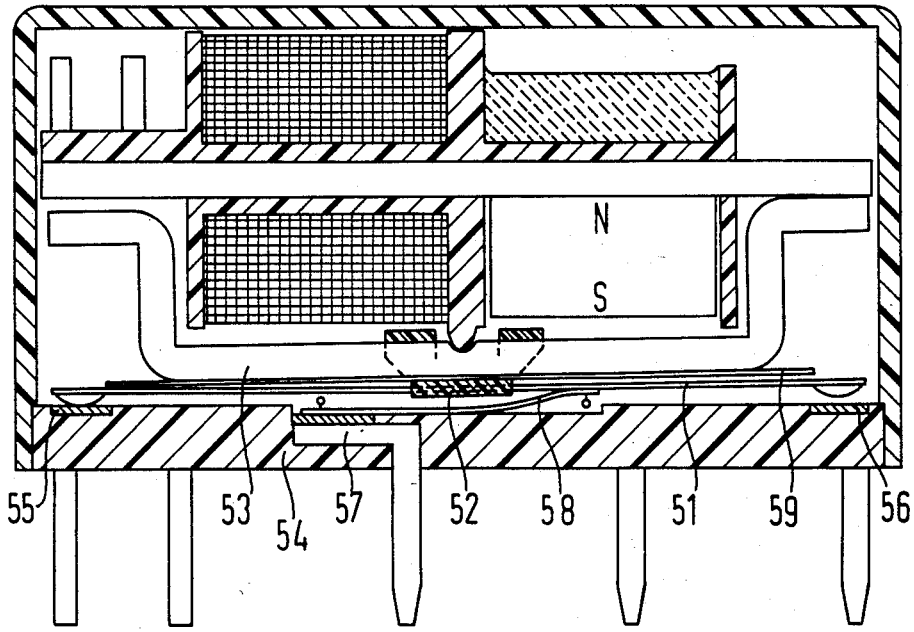

In the form of the invention shown in FIG. 9, contact springs 51 are secured to an armature 53 through the mechanism of an insulator piece 52. A pedestal 54 carries cooperating contact elements 55 and 56 as well as a terminal element 57 for the contact spring 51. The electrical connection between the terminal element 57 and the contact spring 51 is provided by means of a flexible copper foil 58. A smooth insulator film 59 is disposed between the armature 53 and the insulator piece 52 to insulate the armature from the contact spring 51 upon actuation.

Figure 10:
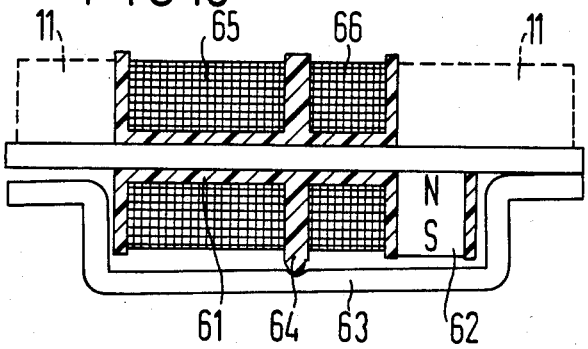
FIGS. 10 through 26 are fragmentary views of coil, core and armature structures illustrating different types of disposition of these elements.

FIGS. 10 through 26 show modifications of the magnet system of FIG. 1 without the contact springs or the terminal elements being shown specifically. In FIG. 10, there is shown a coil body 61 which differs from that of FIG. 1 in that it provides a larger winding space and a permanent magnet 62 which is smaller than in FIG. 1. In order to be able nevertheless to seat an armature 63 in its center on a centrally disposed flange 64, the windings are divided into two portions 65 and 66. A space for a getter 11 is also indicated with broken lines. The version of FIG. 10 is more pronouncedly monostable than that in FIG. 1 due to the greater distance of the permanent magnet 62 from the pivot point of the armature 63.

Figure 11:
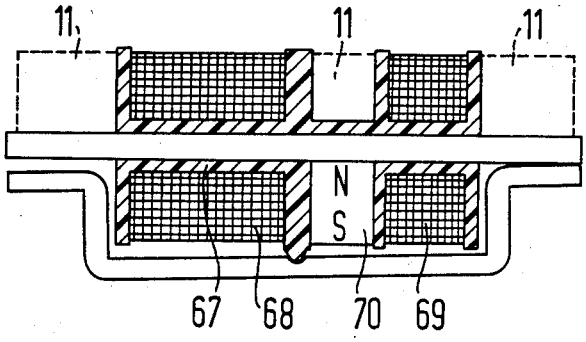

In FIG. 11 there is shown a coil body 67 having two windings 68 and 69, with a permanent magnet 70 being disposed between the separate windings. In this embodiment, the permanent magnet 70 lies close to the pivot point of the armature so that this relay is asymmetrical to only a slight degree and is more bistable.

Figure 12:
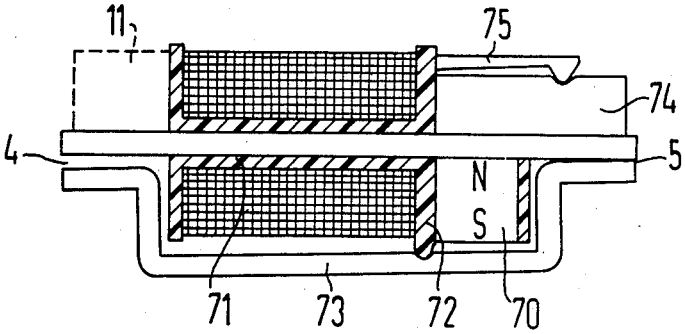

In the embodiment shown in FIG. 12, there is provided a coil body 71 which has an enlarged winding space with an armature 73 being eccentrically seated on a coil flange 72. This effects strokes of different sizes in the working air gaps 4 and 5. Such an embodiment can be useful for a special contact arrangement where, for example, one contact requires a larger contact opening than the other. FIG. 12 also shows the attachment of a getter tablet 74 by means of a flexible mount 75 applied to the coil body 71. Such a manner of fastening is, of course, also possible in all the other embodiments of the relay shown.

Figure 13:
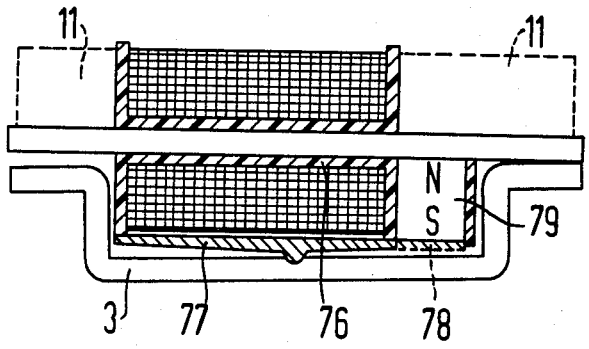
Figure 14:
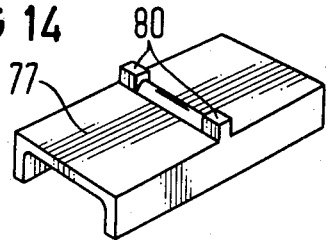

FIG. 13 shows a magnet system including a base body 76 which has an enlarged winding space. The coil structure is bridged over by a bearing plate 77 consisting of metal or a synthetic resin to provide a means for centrally seating the armature 3. When the bearing plate 77 is composed of a low retentivity material and, as indicated with broken lines, when it is provided with a continuation 78 extending beyond a permanent magnet 79, then it additionally serves as a flux guide for the permanent magnet flux. The bearing plate 77 is shown more specifically in FIG. 14, wherein lateral projections 80 are illustrated which serve to guide the armature 3.

Figure 15:
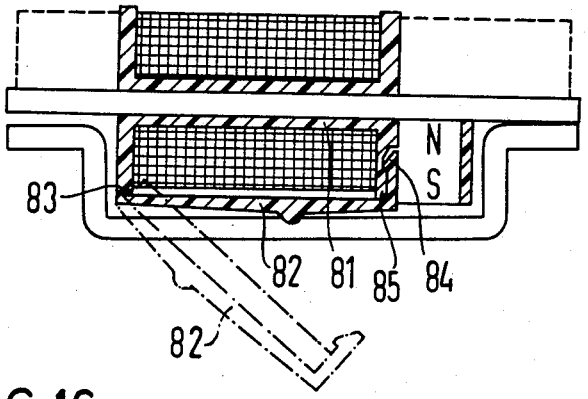

In FIG. 15 there is illustrated an embodiment of a coil body 81 utilizing a bearing bridge 82 which is applied as one piece and is hinged to the coil body by means of a filmstrip hinge 83. The hinge can be locked to the coil body flange 85 with a hook 84 after the coil has been wound.

Figure 16:
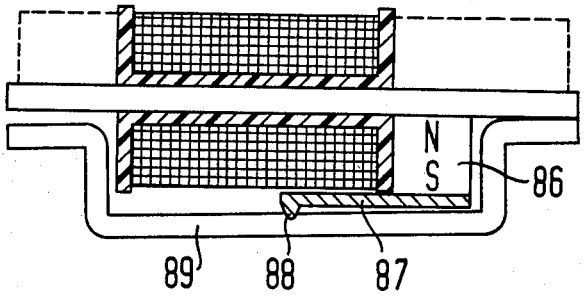

In the embodiment of FIG. 16, there is provided a carrier 87 which is secured to a permanent magnet 86, the carrier 87 forming a knife-edge bearing 88 acting against an armature 89. When the carrier 87 is manufactured of low retentivity material, then it also serves additionally as a flux guide for the permanent magnet flux. An adjustment of the armature stroke for the armature 89 can be accomplished by suitably bending the carrier 87.

Figure 17:
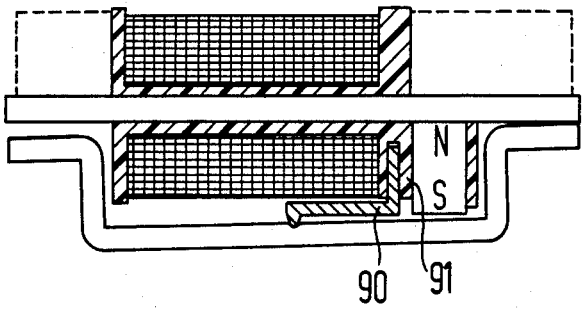

With reference to FIG. 17, there is shown a bearing angle 90 which is set into a coil flange 91 and pivots against the armature.

Figure 18:
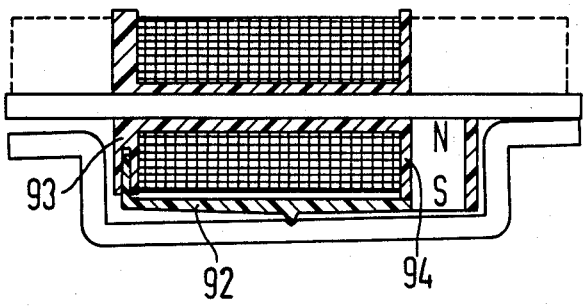

A similar arrangement is shown in FIG. 18 where a bearing angle 92 is inserted into a coil flange 93 and rests against the opposite coil flange 94.

Figure 19:
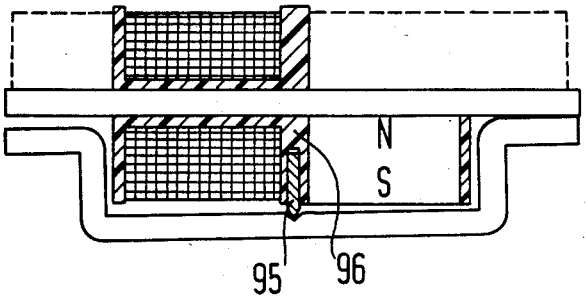

In FIG. 19 there is shown a bearing plate 95 composed of metal or a synthetic resin which is pressed into a coil flange 96. In this embodiment, also, an adjustment of the stroke of the armature is possible by displacing the bearing plate 95 in the coil flange 96.

Figure 20:
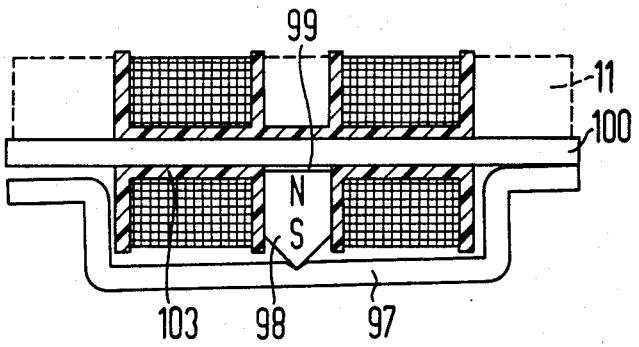

FIG. 20 illustrates a bistable magnet system wherein an armature 97 seats a knife-edge provided directly on a permanent magnet 98. The adjustment of the armature stroke can be made by inserting laminae 99 between the permanent magnet 98 and its core 100.

Figure 21:
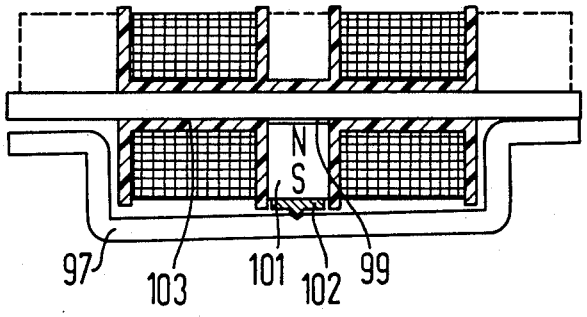

In FIG. 21 there is shown a similar embodiment, the only difference being that the armature 97 is not seated directly on the permanent magnet 101 but rather on a separate bearing plate 102 in which the permanent magnet 101 is bottomed. This bearing plate also can be fabricated of metal or synthetic resin. If it consists of insulating material, then it can be manufactured in one piece with the coil body 103. In this case, the permanent magnet 101 can be plugged into the one-piece structure.

Figure 22:
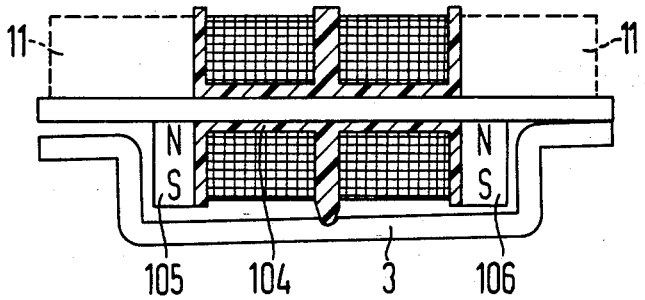

FIG. 22 shows a symmetrical structure of a coil body 102 having two permanent magnets 105 and 106 on either side thereof. The magnet system is monostable when one permanent magnet is attenuated in comparison to the other. The system is bistable when both magnets are magnetized to the same degree. A separate magnetic balance and an adjustment of the relay characteristic is thus possible in this manner.

Figure 23:
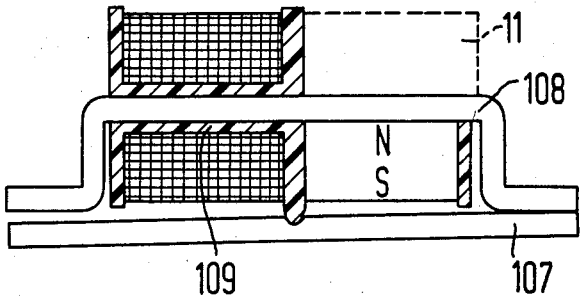

FIG. 23 shows a magnet system having a straight armature 107 and a core 108 which is elbowed at both ends. A coil body 109 or its associated core 108 must be designed in two pieces in order to facilitate assembly, or the core 108 must be embedded immediately when injecting the coil body.

Figure 24:
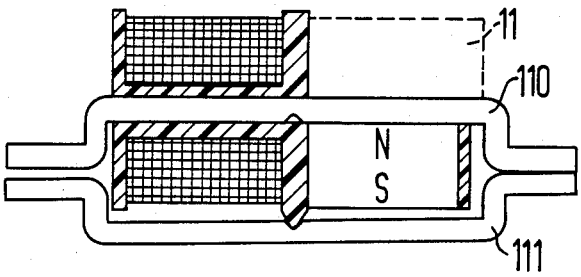

FIG. 24, there is provided a core 110 as well as an armature 111, both of which are elbowed at their opposed ends. Identical parts can therefore be employed for the core and the armature, the two being rotated by 180° as shown in FIG. 24. The same problem of assembling the core and the coil body exists as in the embodiment shown in FIG. 23.

Figure 25:
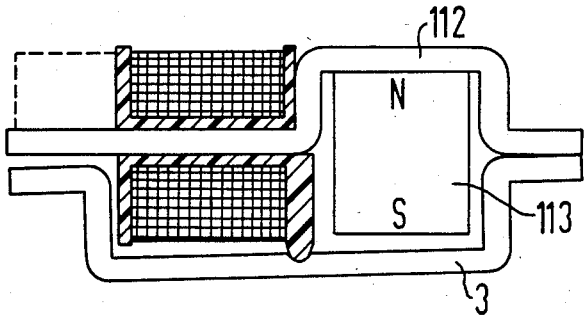

Considering FIG. 25, there is an embodiment shown with a core 112 which itself is provided with an elbow-type structure near one end. This enables a particularly large volume space for the permanent magnet 113 in combination with an armature 3 as shown in FIG. 1.

Figure 26:
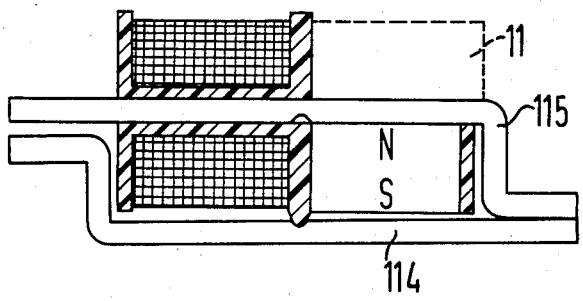

FIG. 26 represents the most efficient solution for the magnet system. There is provided an armature 114 which is designed to be identical to the core 115, namely, both are elbowed at one end. In this case, the core can be subsequently pressed onto the coil body as in FIG. 1.

Figure 27:
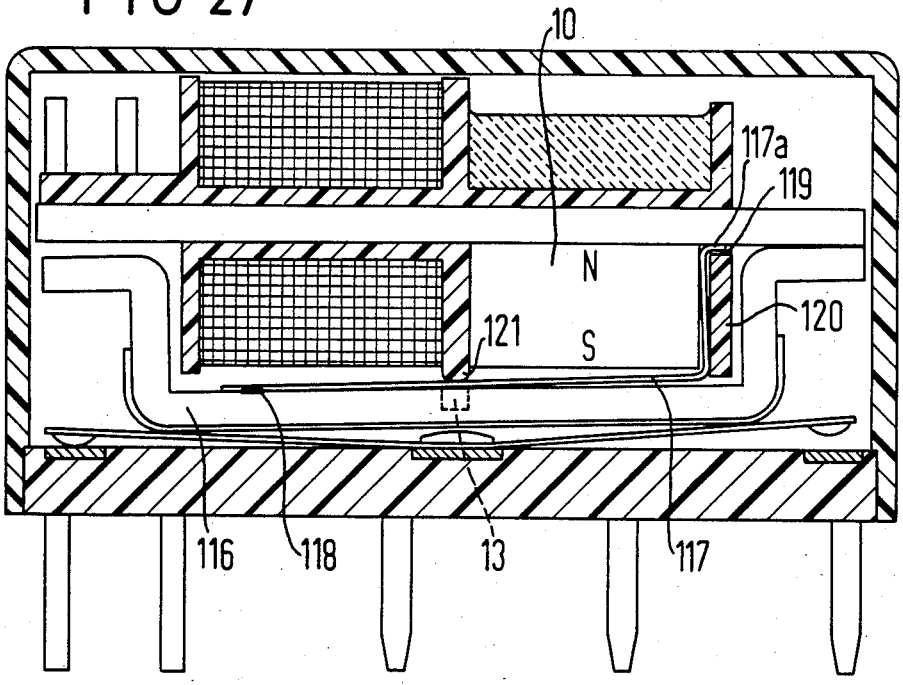
FIG. 27 is a further modified form of the relay shown in FIG. 1.

Finally, in FIG. 27 there is shown a spring-seated armature 116 employing a bearing spring 117 which is welded on at the weld joint 118. During assembly, the bearing spring 117 is engaged with a hook-like end **117*a* into a recess of a coil flange 120. The permanent magnet 10 is subsequently inserted from the side. The armature 116 is supported on a rounded bearing flange 121 and is restrained on all sides. The lateral projections 13 of the bearing flange serve as impact protection. The bearing spring 117 exerts effective pressure on the armature and promotes the monostability of the magnet system. In the remaining details, the relay shown in FIG. 27 is essentially similar to the relay shown in FIG. 1**.

It should be evident that various modifications can be made to the described embodiments without departing from the scope of the present invention.

I claim as my invention:

1. A polarized electromagnetic relay comprising:
a housing,
a coil core within said housing,
a coil body positioned along said core,
at least one coil winding positioned along said coil body,
a rocker armature pivotally mounted at its center portion beneath said coil, said rocker armature having opposed end portions providing working air gaps with respective ends of said core, the ends of said rocker armature disposed adjacent the ends of said coil core,
a permanent magnet disposed at one side of said coil winding, said permanent magnet having one pole in close proximity to said coil core,
a pedestal positioned in said housing,
stationary contacts secured to said pedestal, and
spaced movable contact elements on said pedestal below said rocker armature being disposed between said pedestal and said coil body and positioned to be selectively actuated by rocking movement of said rocker armature.

2. A relay as claimed in claim 1 which includes:
a coil body flange extending from said core, said armature being seated on said flange in proximity to its center of gravity.

3. A relay as claimed in claim 2 wherein:
said flange has a cylindrical shaped projection and said armature has a cylindrical depression into which said projection is received.

4. A relay as claimed in claim 1 which incudes:
an insulating film disposed between said armature and said movable contact elements.

5. A relay as claimed in claim 1 which includes:
projections on said coil body adjacent said armature, said projections being seated against said pedestal and defining the distance between said armature and said movable contact elements.

6. A relay as claimed in claim 1 which includes:
means providing a mortise joint between said coil body and said pedestal.

7. A relay as claimed in claim 1 which includes:
contact terminal elements embedded in said pedestal, and contact surfaces for said contact elements flush with the surface of said pedestal.

8. A relay as claimed in claim 1 in which:
said contact elements include stationary contact elements and prestressed movable contact elements having a spring bias urging said movable contact elements toward said armature, and
terminal elements extending through said pedestal.

9. A relay as claimed in claim 8 in which:
said movable contact elements include an integral bearing portion, said bearing portion being received in a notch of a terminal element.

10. A relay as claimed in claim 8 which includes:
an insulator piece securing said armature to said movable contact elements, and
a conductive foil electrically connecting said movable contact elements to said terminal elements.

11. A relay as claimed in claim 1 in which said coil body includes a flange having a bearing surface formed thereon and coils on said core on both sides of said flange.

12. A relay as claimed in claim 1 which includes:
a bearing element disposed between said coil winding and said armature.

13. A relay as claimed in claim 12 wherein said bearing element is composed of ferromagnetic material and is positioned to conduct magnetic flux from said permanent magnet.

14. A relay as claimed in claim 12 wherein said bearing element is composed of an insulating material and is secured to said coil body.

15. A relay as claimed in claim 14 which includes:
a filstrip hinge connecting said bearing element to said coil body.

16. A relay as claimed in claim 1 wherein:
said coil core extends beyond said winding and provides a space in which said permanent magnet is located.

17. A relay as claimed in claim 1 wherein:
said coil body has spaced windings therealong, with said permanent magnet being located in the space between said windings.

18. A relay as claimed in claim 17 in which:
said permanent magnet has a knife-edge bearing against said armature.

19. A relay as claimed in claim 17 which includes:
a bearing piece bottoming said permanent magnet and having a bearing surface abutting said armature.

20. A relay as claimed in claim 1 in which:
said coil body has a centrally disposed flange having a bearing surface abutting said armature, and a permanent magnet positioned at each end of said coil body.

21. A relay as claimed in claim 1 in which:
said armature is straight and said coil core has offset end portions beyond said winding in parallel relation to said armature.

22. A relay according to claim 1 in which said coil core and said armature are identically shaped and are rotated relative to each other to provide said working air gaps.

23. A relay according to claim 1 which includes:
a bearing spring securing said armature to said coil body.

24. A relay according to claim 1 which includes:
a movable contact spring having one end at one side of the base of said housing and a free end switchable between two cooperating contact elements disposed at the opposite end of said base, said control spring having a bead formed therein serving as a contact point for said armature.

* * * * *